US007861324B2

(12) United States Patent
Chetelat et al.

(10) Patent No.: US 7,861,324 B2
(45) **Date of Patent: *Jan. 4, 2011**

(54) ANTI-CREEP WAIST-CLOTHING

(76) Inventors: Catherine Chetelat, 420 Torner Rd., Baltimore, MD (US) 21221; Michael Chetelat, 8629 Jessica La., Perry Hall, MD (US) 21228-9689

( * ) Notice: Subject to any disclaimer, the term of this patent is extended or adjusted under 35 U.S.C. 154(b) by 1316 days.

This patent is subject to a terminal disclaimer.

(21) Appl. No.: 11/392,357

(22) Filed: Mar. 29, 2006

(65) Prior Publication Data

US 2006/0230500 A1 Oct. 19, 2006

(51) Int. Cl.
*A41D 1/06* (2006.01)
*A41C 1/00* (2006.01)

(52) U.S. Cl. ..... 2/231; 450/143

(58) Field of Classification Search ..... 2/231–233, 2/329, 330, 336, 255, 256, 257, 258, 259, 2/260, 260.1, 261, 262, 263, 264, 141.2, 2/142, 60; 450/41, 42, 43, 143, 144, 145, 450/146, 151; 223/3

See application file for complete search history.

(56) References Cited

U.S. PATENT DOCUMENTS

| | | | | | |
|---|---|---|---|---|---|
| 159,343 | A | * | 2/1875 | Mills | 2/232 |
| 242,537 | A | * | 6/1881 | House | 2/258 |
| 251,735 | A | | 1/1882 | Ross | |
| 279,549 | A | | 6/1883 | Erianger | |
| 538,337 | A | | 4/1895 | Ludwig | |
| 611,298 | A | * | 9/1898 | Warren | 2/258 |
| 671,191 | A | * | 4/1901 | Hanauer | 2/232 |
| 684,145 | A | * | 10/1901 | Watt | 402/14 |
| 748,830 | A | * | 1/1904 | Wood | 2/260.1 |
| 807,098 | A | | 12/1905 | Valentine | |
| 849,137 | A | | 4/1907 | Kops | |
| 896,022 | A | * | 8/1908 | Janowitz | 2/257 |
| 1,337,901 | A | | 4/1920 | Godward | |
| 1,340,276 | A | | 5/1920 | Koehne | |
| 1,381,965 | A | * | 6/1921 | Cameron, Jr. | 2/232 |
| 1,410,079 | A | * | 3/1922 | Quinn | 2/273 |

(Continued)

FOREIGN PATENT DOCUMENTS

| | | |
|---|---|---|
| EP | 0 237 657 | 3/1986 |

(Continued)

*Primary Examiner*—Alissa L Hoey
(74) *Attorney, Agent, or Firm*—Jansson Shupe & Munger Ltd

(57) ABSTRACT

A pre-assembled anti-creep waist-clothing stay device including a patch having front and back surfaces and sized for application to a crotch-adjacent inner-seam area of the waist-clothing and a stay strip affixed to the back surface of the patch, the stay strip being positioned and sized such that the patch extends beyond edges of the stay strip. In important embodiments, the patch includes a heat-activated adhesive such that, when the patch is applied to the waist-clothing with iron-on heat and pressure, the patch adheres at its back surface to the waist-clothing, thereby securing the stay strip in position to prevent the waist-clothing from riding up and bunching in the crotch area. In certain key embodiments, the anti-creep waist-clothing stay device is a stay strip having first and second sides each of which is coated with an adhesive. Such stay device is affixed within a seam-allowance in the crotch-adjacent area.

10 Claims, 5 Drawing Sheets

U.S. PATENT DOCUMENTS

| | | | | | |
|---|---|---|---|---|---|
| 1,845,809 | A | | 2/1932 | Panes | |
| 1,948,177 | A | * | 2/1934 | Karasic | 2/93 |
| 1,974,162 | A | | 9/1934 | Schlaepfer | |
| 2,056,742 | A | | 10/1936 | Sarachek | |
| 2,294,859 | A | * | 9/1942 | Eckerling | 2/232 |
| 2,360,953 | A | * | 10/1944 | Lippmann | 2/232 |
| 2,411,385 | A | * | 11/1946 | Newman et al. | 2/132 |
| 2,483,952 | A | * | 10/1949 | Wayworth | 2/232 |
| 2,538,699 | A | * | 1/1951 | McTighe | 2/260 |
| 2,595,112 | A | | 4/1952 | Story | |
| 2,595,133 | A | | 4/1952 | Golden | |
| 2,597,179 | A | | 5/1952 | Pohlod | |
| 2,599,636 | A | | 6/1952 | Hull | |
| 2,614,261 | A | * | 10/1952 | McTighe | 2/255 |
| 2,649,586 | A | * | 8/1953 | Josephson | 450/41 |
| 2,692,389 | A | | 10/1954 | Lamkin et al. | |
| 2,702,907 | A | | 3/1955 | Berniker et al. | |
| 2,756,435 | A | * | 7/1956 | Rose | 2/255 |
| 2,773,265 | A | | 12/1956 | Dick | |
| 2,843,852 | A | | 7/1958 | Stone, III | |
| 2,860,081 | A | * | 11/1958 | Eiken | 428/138 |
| 2,864,376 | A | | 12/1958 | Sperack | |
| 2,895,482 | A | | 7/1959 | Marino | |
| 3,030,633 | A | * | 4/1962 | Chalfin | 2/258 |
| 3,032,775 | A | | 5/1962 | Robitaille et al. | |
| 3,037,211 | A | | 6/1962 | Bohm | |
| 3,115,642 | A | | 12/1963 | Haring | |
| 3,126,007 | A | | 3/1964 | Jonas | |
| 3,194,242 | A | * | 7/1965 | Marchisella | 450/109 |
| 3,276,041 | A | * | 10/1966 | Jonas | 2/258 |
| 3,328,809 | A | * | 7/1967 | Payne et al. | 2/269 |
| 3,351,954 | A | * | 11/1967 | Chalfin et al. | 2/255 |
| 3,357,028 | A | | 12/1967 | Lanlado | |
| 3,422,461 | A | * | 1/1969 | Froehlich, Jr. | 2/236 |
| 3,478,748 | A | | 11/1969 | Bjorn-Larsen | |
| 3,502,497 | A | * | 3/1970 | Crocker | 428/311.11 |
| 3,508,550 | A | | 4/1970 | Vollrath | |
| 3,637,230 | A | | 1/1972 | Polk | |
| 3,965,702 | A | * | 6/1976 | Findeisen | 66/173 |
| 4,200,938 | A | * | 5/1980 | LeTourneau | 2/269 |
| 4,647,492 | A | | 3/1987 | Grant et al. | |
| 4,989,273 | A | | 2/1991 | Cromartie | |
| 5,006,393 | A | * | 4/1991 | Isoe | 428/137 |
| 5,626,267 | A | * | 5/1997 | Peruski | 223/84 |
| 6,076,193 | A | | 6/2000 | Hood | |
| 6,089,422 | A | | 7/2000 | Gibson | |
| 6,202,221 | B1 | * | 3/2001 | Ackley, Jr. | 2/256 |
| 6,319,578 | B1 | * | 11/2001 | Nauwelaerts | 428/40.1 |
| 6,446,268 | B1 | | 9/2002 | Lazzarian | |
| 6,526,597 | B1 | * | 3/2003 | Shepard | 2/255 |
| 6,544,101 | B1 | * | 4/2003 | von Sydow et al. | 450/41 |
| 6,986,165 | B2 | * | 1/2006 | Neff et al. | 2/141.2 |
| 7,004,361 | B2 | * | 2/2006 | Thomas | 223/3 |
| 7,132,144 | B2 | * | 11/2006 | Roberts | 428/40.2 |
| 7,323,075 | B1 | * | 1/2008 | Sagan et al. | 156/196 |
| 7,328,460 | B1 | * | 2/2008 | Mancini | 2/232 |
| 2003/0135907 | A1 | * | 7/2003 | Sanchez et al. | 2/67 |
| 2004/0016778 | A1 | * | 1/2004 | Thomas | 223/3 |
| 2006/0218698 | A1 | * | 10/2006 | Toyne | 2/231 |
| 2006/0230499 | A1 | * | 10/2006 | Davis | 2/255 |
| 2007/0157369 | A1 | * | 7/2007 | Uchibori et al. | 2/255 |
| 2007/0294804 | A1 | * | 12/2007 | Pinelli | 2/231 |
| 2008/0127396 | A1 | * | 6/2008 | Toyne | 2/232 |
| 2008/0127397 | A1 | * | 6/2008 | Toyne | 2/232 |
| 2008/0127398 | A1 | * | 6/2008 | Ryan | 2/269 |
| 2009/0025124 | A1 | * | 1/2009 | Gearhart | 2/406 |
| 2009/0077771 | A1 | * | 3/2009 | Baba | 24/72.1 |

FOREIGN PATENT DOCUMENTS

| | | |
|---|---|---|
| JP | 11-131311 | 5/1999 |
| JP | 2001-262401 | 9/2001 |
| WO | WO02/085641 | 10/2002 |

* cited by examiner

ANTI-CREEP WAIST-CLOTHING

RELATED APPLICATION

This application claims the benefit of U.S. application Ser. No. 11/096,666, filed Apr. 1, 2005, the contents of which are incorporated herein.

FIELD OF THE INVENTION

The present invention relates to the field of stays for garments and, more particularly, to clothing stays for preventing material of the leg-portions from riding up and bunching in the crotch area of the garment.

BACKGROUND OF THE INVENTION

Waist-garments, such as shorts, swimsuits, even full-length trousers and various other similar garments, often share a particular problem. The material of the leg-portions along the inner-seams tends to ride up and bunch in the crotch area.

U.S. Pat. No. 6,076,193 (Hood) describes a clothing arrangement incorporating "a stay member secured to the lateral inner area of the pant leg such that the stay member substantially prevents the interior lateral lower edge from moving towards the crotch when the pant leg is worn by a person." While the Hood invention represents an important advance which overcomes the problem of material riding up and bunching in the crotch area of waist-garments, as described above, significant improvements are needed to make such advantages easily available for people experiencing such problems.

U.S. Pat. No. 2,692,389 (Lamkin) describes a garment stay secured to a garment without sewing it in place. More particularly, the stay is bonded to the garment by a separate patch that, upon application to the garment, traps the stay in place. The patch is bonded to the garment with the use of thermosetting resin and application of heat and pressure. Lamkin's method is complex and difficult to perform.

Known garment stays have a variety of additional problems and disadvantages. In some cases, stays may be positioned in locations on garments which cause skin irritation to the wearers. In other cases, sharp ends of the stays may project through cloth, causing a variety of problems, including causing wear at particular points of garment material. Furthermore, a variety of ways providing stays on garments can be problematic. Furthermore, it would be desirable to have garment stay devices overcoming a variety of problems, including those described above.

OBJECTS OF THE INVENTION

It is an object of the invention to provide an improved anti-creep waist-clothing stay overcoming some of the problems and shortcomings of the prior art, including those referred to above.

Another object of the invention is to provide an improved anti-creep waist-clothing stay preventing the garment leg-portions from riding up and bunching in the crotch area.

Another object of the invention is to provide an improved anti-creep waist-clothing stay designed to deter the wearier's skin irritation by the stay.

Still another object of the invention is to provide an improved anti-creep waist-clothing stay designed for an attachment to the garment without special skills or equipment.

Yet another object of the invention is to provide a pre-assembled anti-creep waist-clothing stay facilitating quick and easy attachment of the stay to the garment.

Another object of the invention is to provide an improved anti-creep waist-clothing stay having ends with smooth finishing inhibiting their poking or tearing through the fabric.

How these and other objects are accomplished will become apparent from the following descriptions and the drawings.

SUMMARY OF THE INVENTION

This invention, which will be described in detail below, is an improvement in anti-creep stays for waist-clothing of the type having leg-portions.

The present invention provides an anti-creep waist-clothing stay device and method of reinforcing crotch-adjacent inner-seam areas overcoming the problems described above. The present invention permits easy and quick waist-clothing retrofitting process without any special skills or equipment. An average person can attach the inventive stay device to the waist-clothing by ironing on or otherwise adhering the stay devices to the crotch adjacent inner-seam areas of the waist-clothing to prevent the waist-clothing material from riding up and bunching in the crotch area. Furthermore, the stay strip of the present invention incorporates a boning material having smooth finishing on its ends which eliminates a common disadvantage of known garment stays such as tearing through the material.

The inventive pre-assembled anti-creep waist-clothing stay device includes a patch having front and back surfaces and sized for application to a crotch-adjacent inner-seam area of the waist-clothing, and a stay strip affixed to the back surface of the patch. The stay strip being positioned and sized such that the patch extends beyond edges of the stay strip.

In highly preferred embodiments of this invention the stay strip is affixed to the patch by an adhesive.

The patch preferably includes a heat-activated adhesive such that, when the patch is applied to the waist-clothing with iron-on heat and pressure, the patch adheres at its back surface to the waist-clothing, thereby securing the stay strip in position to prevent the waist-clothing from riding up and bunching in the crotch area.

In certain preferred embodiments, the stay strip has an affixed side and a free side. The free side is coated with a contact adhesive for pre-application positioning of the stay device on the waist-clothing. In such embodiments, the contact adhesive on the free side has a peel-off cover thereon to protect the adhesive prior to use.

The stay strip may be of any size but preferably no less than about 2 inches long and no more than about one-half inch wide. The stay strip is preferably made of polyester or other polymeric boning materials.

In certain highly preferred embodiments the stay strip is formed by a plurality of generally parallel interconnected monofilaments each having an end-point. In such embodiments the stay strip has convex curved ends with a smooth finishing formed by the end-points being melted together, thus, eliminating roughness and minimizing tearing of the stay strip through the patch or the waist-clothing. The patch has outer edges which are substantially parallel to the corresponding edges of the stay strip such that iron-on interconnection of the stay device to the waist-clothing can be secure all about the stay strip.

Another important aspect of this invention involves a method of reinforcing a waist-clothing of the type having two leg-portions with inner-seams forming a crotch to prevent cloth riding up and bunching in the crotch area. The inventive method includes: providing a pre-assembled anti-creep waist-clothing stay device including a patch having front and back surfaces and sized for application to a crotch-adjacent inner-seam area of the waist-clothing; and a stay strip affixed to the back surface, the strip being positioned and sized such that the patch extends beyond edges of the strip, the patch includes a heat-activated adhesive; placing the stay device on a crotch-adjacent inner-seam area of the waist-clothing with the back of the patch facing the leg-portion; and pressing hot iron on the front surface of the patch for iron-on activation of the heat-reactive adhesive such that the patch adheres at its back surface to the waist-clothing, thereby securing the stay strip in a position to prevent the waist-clothing from riding up and bunching in the crotch area.

In certain preferred examples of the inventive method, the free side of the stay strip is coated with a contact adhesive covered with a protective peel-off film. In such preferred examples, the method includes the further step of peeling the protective film off the free side of the stay strip prior to placing the stay device on the leg-portion. Whereby the contact adhesive holds the stay device in desired position prior to pressing the iron and supports the iron-on attachment of the stay device to the waist-clothing.

The present invention further provides an anti-creep waist-clothing of the type having two leg-portions sewn together forming a crotch with each leg-portion having an inner-seam extending from the crotch down along the leg-portion. The pre-assembled anti-creep stay device is adhered to a crotch-adjacent inner-seam area of the waist-clothing. Thus, the anti-creep waist-clothing is free of cloth riding up and bunching in the crotch area.

The term "waist-clothing," as used herein, refers to garments worn below a person's waist-line and having two leg-portions. Such garments include shorts, skorts, full-length trousers, swimsuits and other similar clothing articles.

In other preferred embodiments of the present invention, the free side of the stay strip and the beyond-edge portion of the patch are both coated with a heat-activated adhesive such that, when the stay device is applied to the waist-clothing with iron-on heat and pressure, the patch and the stay strip each directly adhere to the waist-clothing.

Another important embodiment of this invention is an anti-creep waist-clothing stay device which is a stay strip having first and second sides each of which is coated with an adhesive. In highly preferred examples of this embodiment, the adhesive is a heat-activated adhesive. In certain other preferred examples the adhesive is a contact adhesive covered with a peel-off cover on the adhesive on each side of the strip to protect the adhesive prior to use. In certain of such embodiments, the stay strip is formed of a plurality of generally parallel interconnected monofilaments with end-points, most preferably with the ends of the stay strip having a smooth finishing formed by the end-points being melted together.

Another aspect of the present invention is an anti-creep waist-clothing stay device including a stay strip formed by a plurality of generally parallel interconnected monofilaments having end-points, the ends of the stay strip having a smooth finishing formed by the end-points being melted together.

The present invention also includes reinforced anti-creep waist-clothing of the type having two leg portions together forming a crotch, each leg portion including an inner-seam extending from the crotch down along the leg portion and having overlapping cloth forming a seam-allowance. In such waist-clothing, an anti-creep stay strip of the sort described is affixed within the seam-allowance in a crotch-adjacent area. Thus, cloth of the waist-clothing is restrained from riding up and bunching in the crotch area.

In most preferred embodiments of the just-described reinforced anti-creep waist-clothing, the seam-allowance is an open seam-allowance. In certain highly preferred embodiments of the reinforced anti-creep waist-clothing, the anti-creep stay strip is affixed within the seam-allowance by adhesive on its first and second sides.

The present invention further provides a method of making a waist-clothing with two leg portions together forming a crotch, each leg portion including an inner-seam extending from the crotch down along the leg portion and having overlapping cloth forming a seam-allowance. The inventive method includes: providing an anti-creep stay strip; placing the stay strip within the seam-allowance in a crotch-adjacent area; and affixing the stay strip to the seam-allowance, thereby to restrain cloth of the waist-clothing from riding up and bunching in the crotch area.

In highly preferred examples of the method just described, the seam-allowance is an open seam-allowance. It must be noted that the inner-seam may also be a so-called "hidden seam" enclosing cut edges of the seam-allowance. The stay strip may be inserted into such hidden seam and placed between the overlapping cloth of the seam-allowance forming such hidden seam, thus enclosing the affixed stay strip within the seam-allowance to provide comfort to the waist-clothing wearer.

In certain preferred embodiments of the just-described inventive method, the affixing is by adhesive on the first and second sides of the stay strip. In some preferred examples of this method the adhesive is heat-activated adhesive and the affixing is by heat activation and pressure. In certain other examples the adhesive is contact adhesive and the affixing is by application of pressure. It should further be noticed that even though the use of adhesive is preferred, the affixing of the stay strip may also be performed by stitching though the overlapping cloth and the stay strip itself, in its position between the cloth layers.

The term "seam-allowance" as used herein refers to an area of cloth between the cut edge of a leg-panel and the inner-seam connecting two leg-panels to form a leg portion.

The term "open seam-allowance" as used herein refers to at least two layers of seam-allowance-cloth with their cut edges non-hidden in a finished inner-seam. Such layers of seam-allowance-cloth may be separate or connected at their cut edges by overlooking stitching.

The term "within the seam-allowance" as used herein refers to any of the spaces between adjacent layers of overlapping cloth at least one of which is seam-allowance-cloth (i.e., cloth beyond the seam). In some cases, there are choices of exactly which two layers of cloth should be in contact with the stay strip of this invention.

DETAILED DESCRIPTION OF PREFERRED EMBODIMENTS

Figure 1:
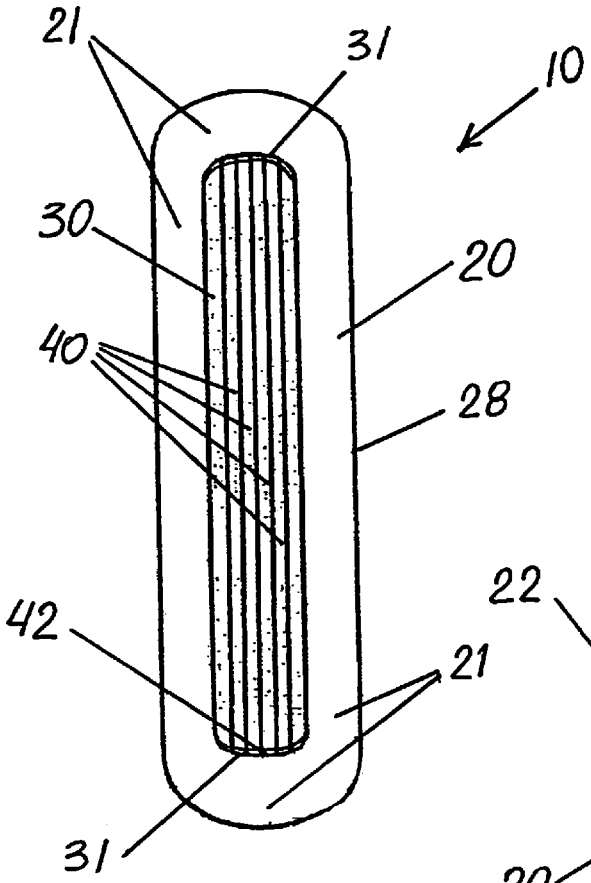
FIG. 1 is a back view of a pre-assembled anti-creep waist-clothing stay device.

Referring to FIGS. 1-6A, a pre-assembled anti-creep waist-clothing stay device 10 includes a patch 20 having front surface 22 and back surface 24, and a stay strip 30 affixed to back surface 24, stay strip 30 being positioned and sized such that patch 20 extends beyond edges of strip 30. As schematically shown on FIGS. 2, 3, 3A, 6 and 6A, stay strip 30 is affixed to patch 20 by an adhesive 14.

FIGS. 2, 3, 3A, 6 and 6A further schematically illustrate patch 20 having a heat-activated adhesive 26 on such that, when patch 20 is applied to a waist-clothing 50 with iron-on heat and pressure, patch 20 adheres at its back surface 24 to waist-clothing 50, thereby securing stay strip 30 in position to prevent waist-clothing from riding up and bunching in a crotch area 55.

Figure 3A:
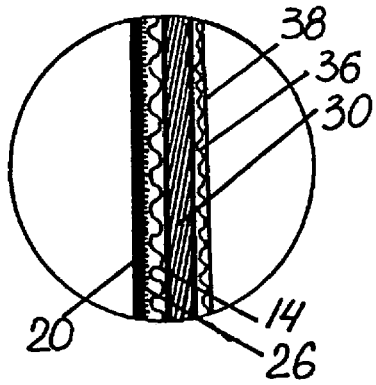
FIG. 3A is a magnified fragmentary view of the portion indicated in FIG. 3.
Figure 2:
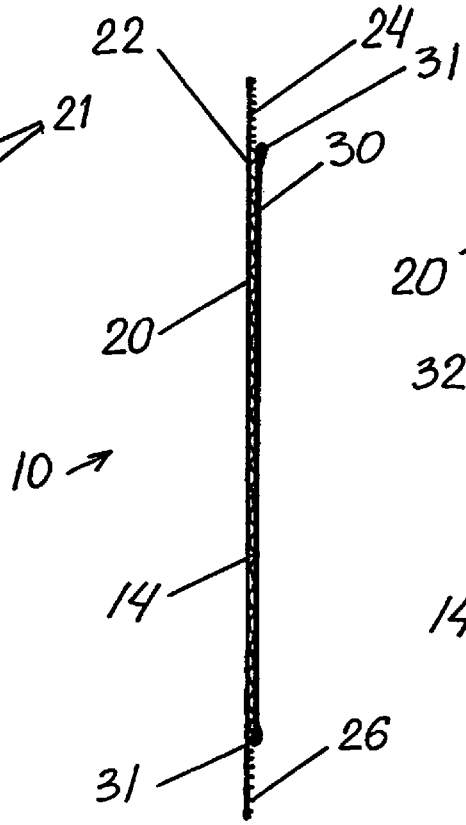
FIG. 2 is a side view of the stay device of FIG. 1.
Figure 3:
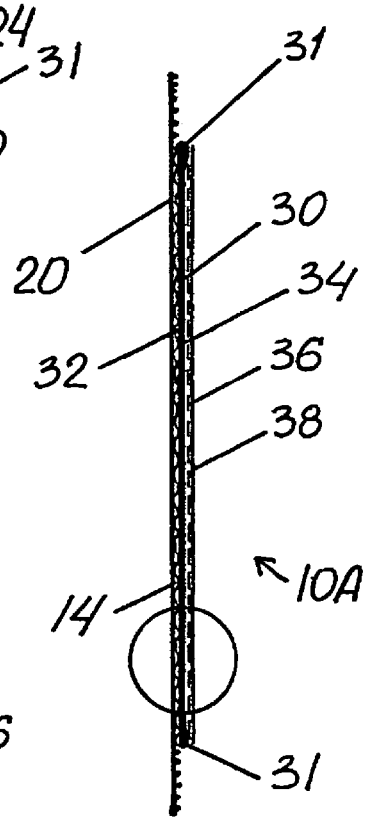
FIG. 3 is a side view of another embodiment like that of FIG. 2, but with an added feature.

Stay strip 30 has an affixed side 32 and a free side 34. FIG. 3 and 3A further schematically illustrate the certain preferred embodiment 10A having free side 34 coated with a contact adhesive 36 for pre-application positioning of stay device 10A on waist-clothing 50. Contact adhesive 36 on free side 34 has a peel-off cover 38 to protect adhesive 36 prior to use.

Figure 6:
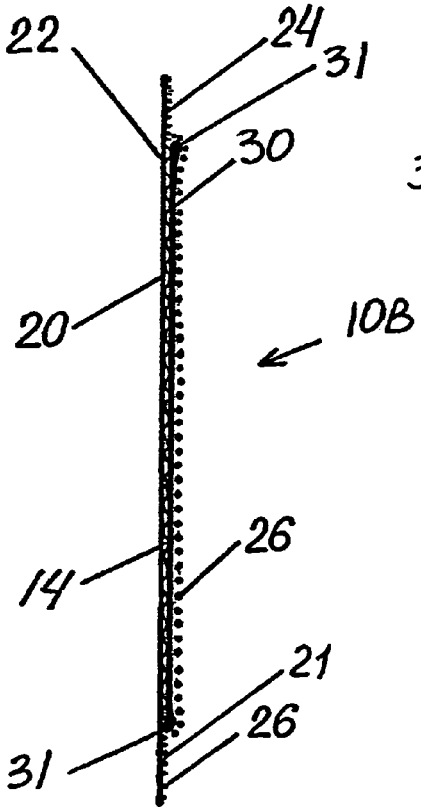
FIG. 6 is a side view of another embodiment like that of FIGS. 2 and 3, but with a different added feature.
Figure 6A:
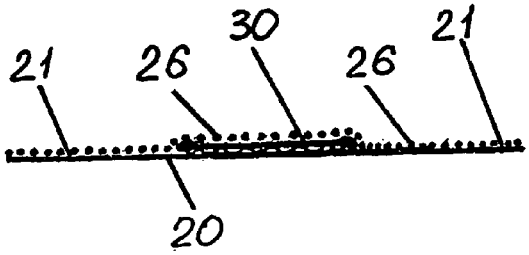
FIG. 6A is a width-side view of embodiment of FIG. 6.

FIG. 6 schematically illustrates another preferred embodiment 10B having free side 34 of stay strip 30 and a beyond-edge portion 21 of patch 20 both coated with heat-activated adhesive 26 such that, when stay device 10B is applied to waist-clothing 50 with iron-on heat and pressure, patch 20 and stay strip 30 each adhere to waist-clothing 50.

Figure 7:
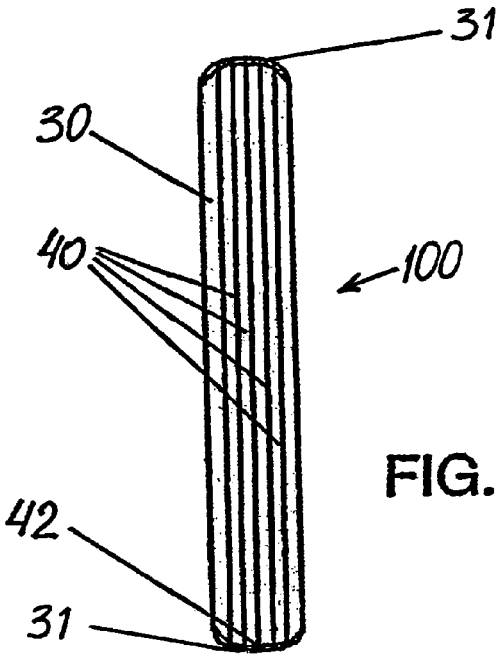
FIG. 7 is a front view of an anti-creep waist-clothing stay strip in accordance with this invention.

As shown in FIGS. 1 and 7, stay strip 30 is formed by a plurality of generally parallel interconnected monofilaments 40 each having an end-point 42. Stay strip 30 has convex curved ends 31 with a smooth finishing formed by the end-points 42 being melted together, thus eliminating roughness and minimizing tearing of stay strip 30 through patch 20 or waist-clothing 50. Patch 20 has outer edges 28 which are substantially parallel to the corresponding edges of stay strip 30 such that iron-on interconnection of stay device 10 to waist-clothing 50 can be secure all about stay strip 30.

Figure 4:
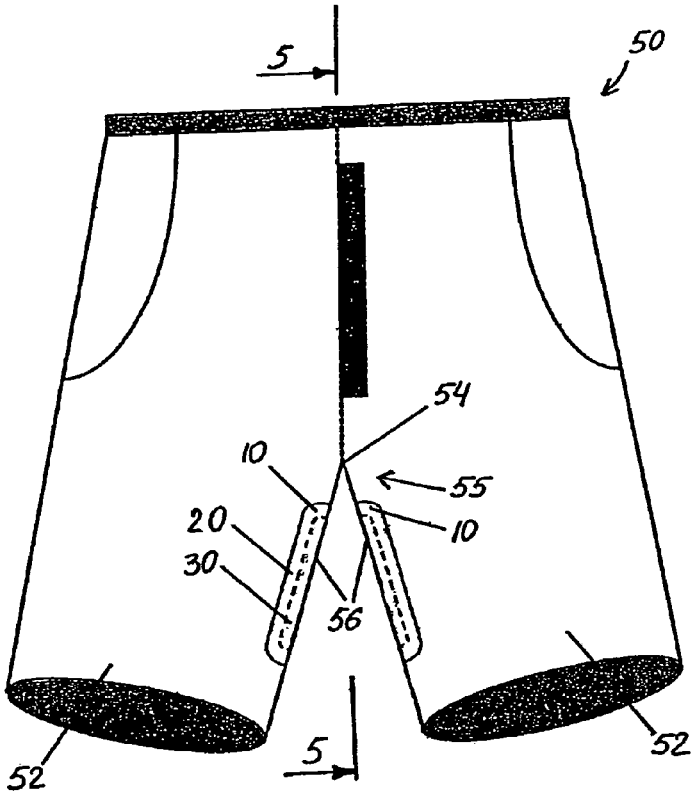
FIG. 4 is a perspective view of a waist-clothing with two iron-on stay devices of FIG. 1 installed thereon.
Figure 5:
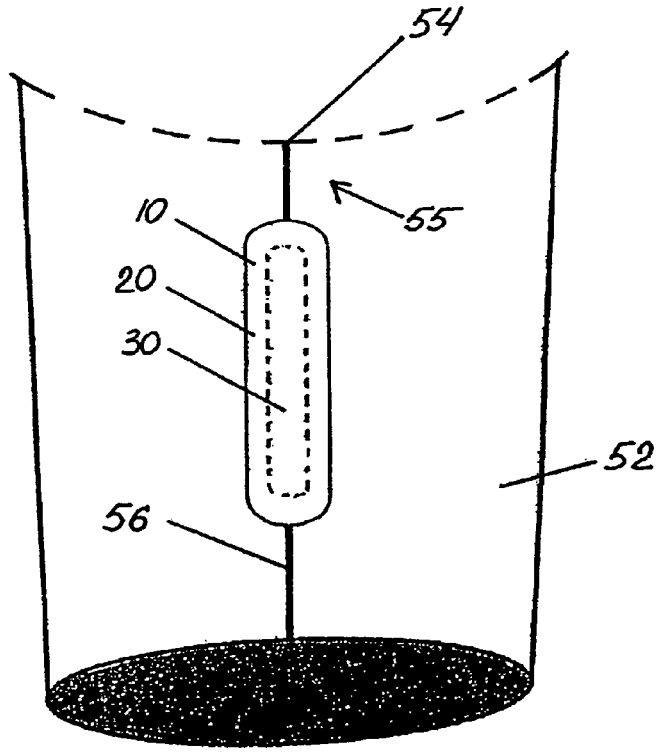
FIG. 5 is a perspective sectional view taken along a portion of section 5-5 as indicated on FIG. 4.

FIG. 4 illustrates anti-creep waist-clothing 50 of the type having two leg portions 52 together forming a crotch 54. Each leg portion 52 includes an inner-seam 56 extending from crotch 54 down along leg portion 52. As best shown in FIG. 5, pre-assembled anti-creep stay device 10 is adhered to crotch-adjacent inner-seam area 55 of waist-clothing 50. Thus, cloth of waist-clothing 50 is restrained from riding up and bunching in crotch area 54.

Figure 9A:
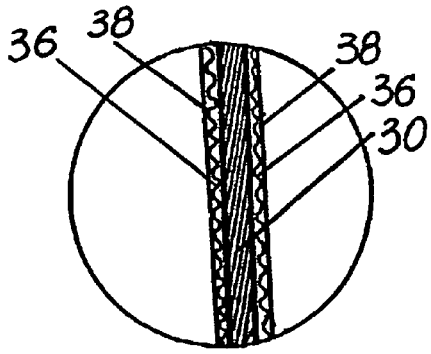
FIG. 9A is a magnified fragmentary view of the portion indicated in FIG. 9.
Figure 8:
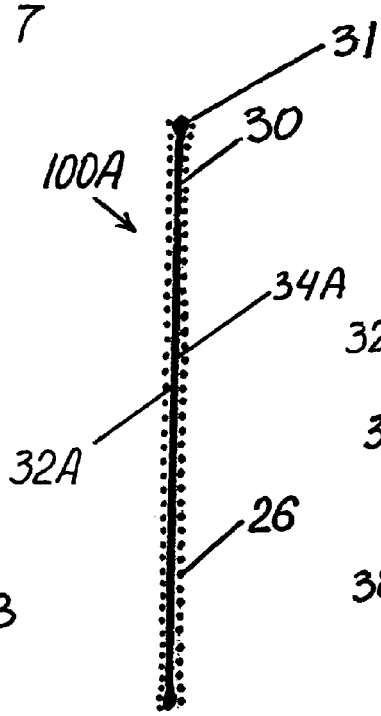
FIG. 8 is a side view of the device like that of FIG. 7.
Figure 9:
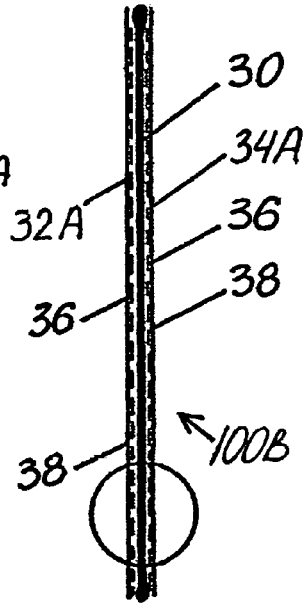
FIG. 9 is a side view of another embodiment like that of FIG. 8.

FIG. 7 illustrates another important embodiment of this invention, an anti-creep waist-clothing stay device 100 which is stay strip 30 of interconnected monofilaments 40 (as described above) and ends 31 which have monofilament end-points 42 melted together (as described above). As illustrated on FIG. 8, one highly preferred embodiment 100A has each first side 32A and second side 34A coated with a heat-activated adhesive 26. FIGS. 9 and 9A illustrate another preferred embodiment 100B which has contact adhesive 36 on each of first side 32A and second side 34A, contact adhesive 36 being covered with peel-off covers 38 to protect adhesive 36 prior to use.

Figure 10:
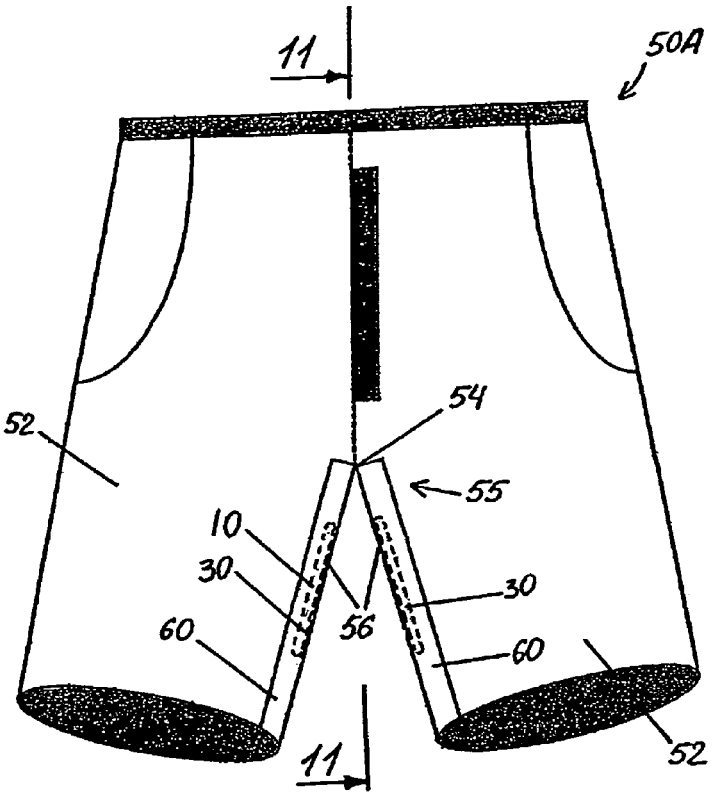
FIG. 10 is a perspective view of a waist-clothing with two strips of FIG. 7 installed thereon.

FIG. 10 illustrates reinforced anti-creep waist-clothing 50A, in this case shorts, having two leg-portions 52 sewn together forming a crotch 54. Each leg-portion 52 includes inner-seam 56 extending from crotch 54 down along leg-portion 52 and having overlapping cloth forming a seam-allowance 60. As illustrated in FIGS. 11-16, anti-creep stay strip 100 is affixed within seam-allowance 60 in crotch-adjacent inner-seam area 55. Thus, cloth of waist-clothing 50 is restrained from riding up and bunching in crotch area 55.

FIGS. 11-14A illustrate the most preferred embodiments of such reinforced anti-creep waist-clothing 50A with seam-allowance 60 being an open seam-allowance 62.

Figure 12:
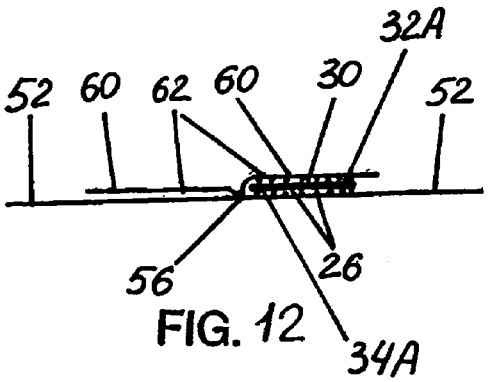
FIG. 12 is a sectional view taken along a section 12-12 as indicated on FIG. 11.
Figure 11:
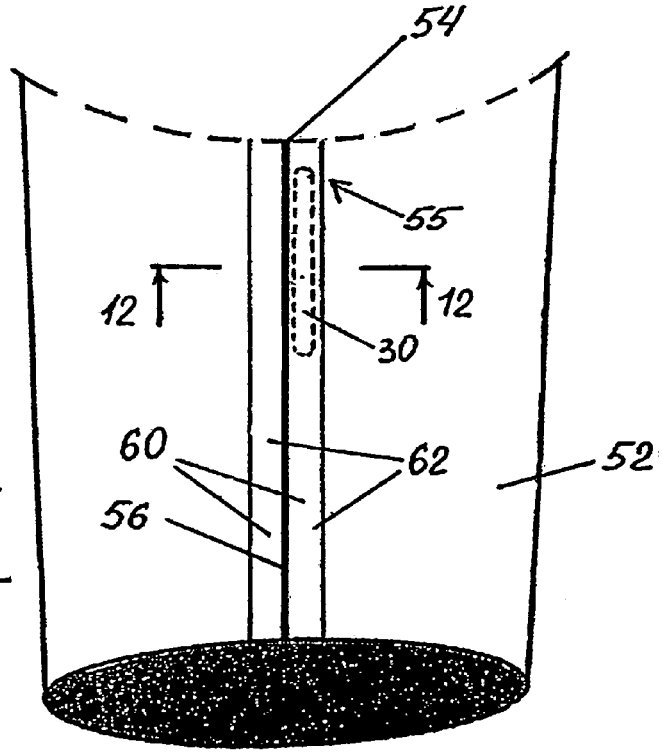
FIG. 11 is a perspective sectional view taken along a portion of section 11-11 as indicated on FIG. 10.

FIGS. 11 and 12 illustrate open seam-allowance 62 with its two parts ironed open each adjacent to different leg-panels. Stay strip 100A is affixed within open seam-allowance 62 by adhering side 32A to one part of seam-allowance 60 and side 34A to adjacent cloth of leg portion 52.

Figure 14A:
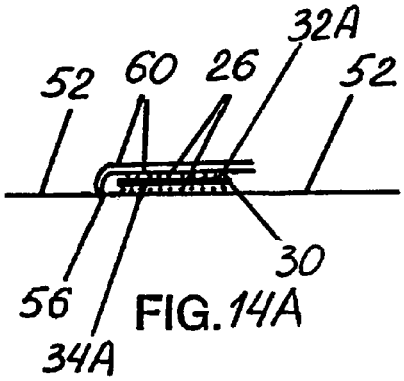
FIG. 14A is a sectional view taken along a section 14-14 as indicated on FIG. 13.
Figure 13:
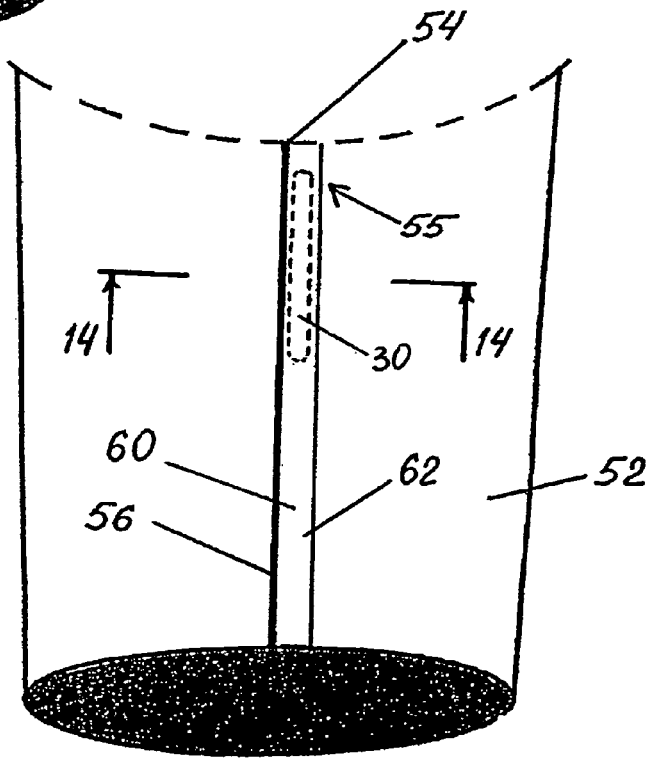
FIG. 13 is another perspective sectional view similar to FIG. 11 but illustrating another example of waist-clothing with stay strips of FIG. 7 installed thereon.
Figure 14B:
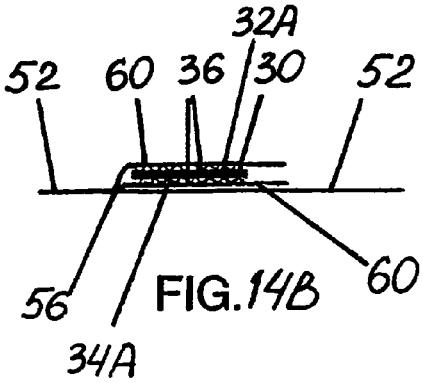
FIG. 14B is a sectional view similar to FIG. 14A but showing another example of affixing the stay strip of FIG. 7 within the seam-allowance.

FIG. 13 illustrates open seam-allowance 62 with its both parts ironed together toward same leg-panel. FIG. 14A shows stay strip 100A affixed within open seam-allowance 62 by adhering side 32A to one part of seam-allowance 62, and side 34A to adjacent cloth of leg portion 52. FIG. 14B shows stay strip 100B affixed within open seam-allowance 62 between two parts of seam-allowance 60 by adhering side 32A to one part and side 34A to another part of seam-allowance 60.

Figure 15:
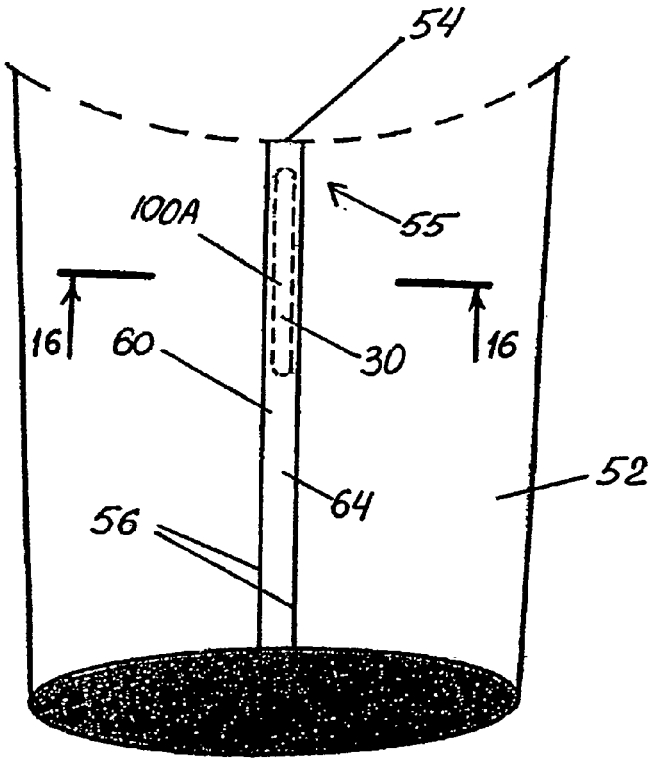
FIG. 15 is yet another perspective sectional view similar to FIGS. 11 and 13 but illustrating another example of waist-clothing with stay strips of FIG. 7 installed thereon.
Figure 16:
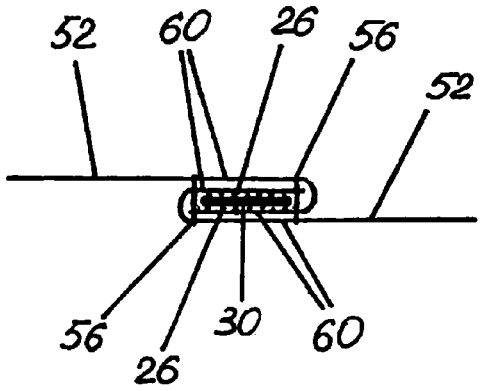
FIG. 16 is a sectional view taken along a section 16-16 as indicated on FIG. 15.

FIGS. 15 and 16 illustrate an embodiment in-which inner-seam 56 is a hidden seam 64 enclosing cut edges of seam-allowance 60. Stay strip 100A is inserted into such hidden seam 64 and placed between the overlapping cloth of seam-allowance 60; thus stay strip 30 is affixed within seam-allowance 60 by adhesive 26 on its first side 32A and second side 34A.

While the principles of the invention have been shown and described in connection with specific embodiments, it is to be understood that such embodiments are by way of example and are not limiting.

The invention claimed is:

1. An anti-creep waist-clothing having two leg portions together forming a crotch, the waist-clothing comprising a stay strip affixed in a crotch-adjacent area of each leg portion, the stay strip being formed by a plurality of separate elongate parallel monofilaments each having end-points, the separate monofilaments extending between the end-points, the end-points being melted together into a single piece forming smooth stay-strip ends, wherein the leg portions are restrained from riding up and bunching in the crotch area.

2. The anti-creep waist-clothing stay device of claim 1 wherein the stay strip has first and second sides each of which is coated with an adhesive.

3. The anti-creep waist-clothing stay device of claim 2 wherein the adhesive is a contact adhesive.

4. The anti-creep waist-clothing stay device of claim 3 further comprising a peel-off cover on the adhesive on each side of the strip to protect the adhesive prior to use.

5. The anti-creep waist-clothing of claim 1 wherein each leg portion includes an inner-seam extending from the crotch down along the leg portion and has overlapping cloth, the stay strip being affixed adjacent to the inner-seam.

6. The reinforced anti-creep waist-clothing of claim 5 wherein the overlapping cloth forms a seam-allowance and the stay strip is affixed within the seam-allowance.

7. The reinforced anti-creep waist-clothing of claim 6 wherein the seam-allowance is an open seam-allowance.

8. The reinforced anti-creep waist-clothing of claim 6 wherein the anti-creep stay strip has first and second sides and is affixed within the seam-allowance by adhesive on the first and second sides.

9. The reinforced anti-creep waist-clothing of claim 8 wherein the adhesive is a contact adhesive.

10. The reinforced anti-creep waist-clothing of claim 8 wherein the seam-allowance is an open seam-allowance.

* * * * *